United States Patent [19]

Tachimoto et al.

[11] 4,373,883

[45] Feb. 15, 1983

[54] APPARATUS FOR PRODUCING GRANULES FROM MOLTEN METALLURGICAL SLAGS

[75] Inventors: Kazuo Tachimoto, Tokyo; Toyosuke Tanoue, Toyonaka, both of Japan

[73] Assignees: Ishikawajima-Harima Jukogyo Kabushiki Kaisha, Tokyo; Sumitomo Metal Industries, Ltd., Osaka, both of Japan

[21] Appl. No.: 236,202

[22] Filed: Feb. 18, 1981

Related U.S. Application Data

[60] Division of Ser. No. 2,099, Jan. 9, 1979, abandoned, which is a continuation-in-part of Ser. No. 828,856, Aug. 29, 1977, abandoned.

[51] Int. Cl.[3] ..... B29B 1/54

[52] U.S. Cl. ..... 425/8

[58] Field of Search ..... 425/8

[56] References Cited

U.S. PATENT DOCUMENTS

| | | | |
|---|---|---|---|
| 2,488,353 | 11/1949 | Unger | 264/9 |
| 3,617,587 | 11/1971 | Nayar | 264/8 |
| 3,829,538 | 8/1974 | Darmara et al. | 264/8 |

*Primary Examiner*—James R. Hall

*Attorney, Agent, or Firm*—Scrivener, Clarke, Scrivener and Johnson

[57] ABSTRACT

An apparatus for manufacturing granules from slags produced in metallurgical furnaces such as blast furnaces, converter furnaces, electric furnaces, reverberatory furnaces comprising means for accelerating a stream of molten slag from a container to a velocity of at least two meters per second, and directing the stream onto a target surface from which it rebounds in the form of an inverted cone of droplets which are projected through the air to cool and to solidify them into granules.

4 Claims, 4 Drawing Figures

APPARATUS FOR PRODUCING GRANULES FROM MOLTEN METALLURGICAL SLAGS

This application is a division of application Ser. No. 002,099 filed Jan. 9, 1979 which itself is a continuation-in-part of application Ser. No. 828,856 filed Aug. 29, 1977, both now abandoned.

DETAILED DESCRIPTION OF THE INVENTION

This invention provides apparatus for producing granules from slags produced in metallurgical furnaces such as blast furnaces, converter furnaces, electric furnaces, reverberatory furnaces, and the like.

Because such metallurgical slags are produced in great quantities there is a demand for their disposition in a nonpolluting manner, preferably by converting them into useful substances such as an aggregate used in concrete making. For this purpose, slag granules having a mean diameter of 2 to 4 mm, a maximum diameter of less than 15 mm and preferably less than 10 mm, and of a uniform size distribution, a strength equivalent to river sands, and spherical shape are particularly desired.

Methods and apparatus are known for making such granules solidified by a water spray, and also by the hydrogranulation process, in which molten slag is comminuted with a water jet. However, no known method or apparatus has been successful in producing granules of the size, size distribution and strength mentioned above. Granules having the desired properties can be produced by the apparatus of this invention.

The present invention will become more apparent from the following description of preferred embodiments thereof taken in conjunction with the accompanying drawings, in which.

Figure 1:
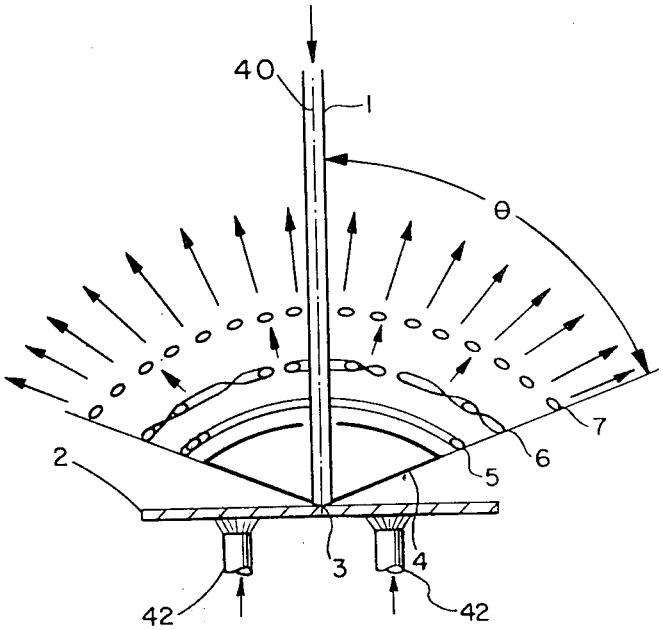
FIG. 1 is a schematic drawing of the inverted cone film of molten slag rebounding from the target surface.

FIG. 1 represents observations of the rebounding inverted cone of slag made by high speed photography. Slag stream 1 impinges on target surface 2 at point 3, from which an inverted conical film 4 of slag of a half apex angle $\theta$ is formed with the central axis 40 of the slag stream. Slag film cone 4 degenerates from its outer circular edge into a series of expanding slag rings 5 and 6 which, in turn, are broken into numerous spherical droplets 7. Moving outwardly in all directions along the conical shape, the droplets are progressively cooled and solidified by the surrounding air to form granules.

The velocity with which the molten slag stream impinges upon the target must be at least 2 m/sec, and the target surface 2 must be non-wetting with respect to the molten slag. This latter requirement is achieved by forming target surface 2 of hard, heat resisting and heat conducting material such as iron, mild steel, stainless steel, copper, or copper alloy. The target surface may be reinforced by a hard facing through a surface treatment such as aluminizing, parkerizing, chromium plating, carburizing, nitriding, or buttering of superalloy. In other cases, ceramics and graphite, though not particularly heat conductive, were found also satisfactory. In any case, the surface should be finished to a high degree of smoothness such as that obtained by fine grinding or cold rolling, and should be kept cooled. Cooling water applied to the side of the target opposite the impingement side is generally sufficient. Alternatively, the target surface 2 can be made non-wetting by coating it with a non-wetting film forming substance such as water, aluminum powder paint, oil, lime milk, or graphite powder paint. A very thin film, for example one obtained when a steel plate is moistened by spray of fine water mist, is generally sufficient. The following experiments demonstrate these points.

EXAMPLE 1

In FIG. 1 target surface 2 is a horizontal copper plate of 10 mm thickness, cooled from below by water sprays 42. Slag stream 1 may be a blast furnace slag, and LD converter slag, or a copper converter slag (the return slag) directed normally to target surface 2. The non-wetting substances tested were: either aluminum powder paint for blast furnace slag, lime milk, or oil for converter slag, and either none or water for return slag. Self-granulation was achieved in all cases with an impinging velocity of at least 2 m/sec, though the formed granules tended to be coarse and irregularly shaped near this lower limit.

EXAMPLE 2

Figure 2:
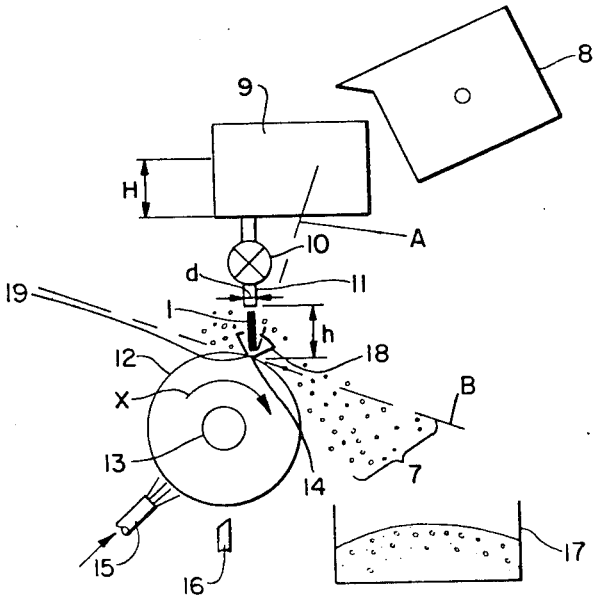
FIG. 2 illustrates one embodiment of the invention; of the invention.

In FIG. 2, 8 is the source of molten slag supplying tundish 9 in which a mass of molten slag of depth H is maintained, 10 is a valve, 11 a nozzle having diameter d, 12 is a rotating drum target which is driven by a mechanism (not shown) through drive shaft 13 in the direction of arrow X. Cooling water is supplied through drive shaft 13. Rotating the drum up to 100 rpm causes the impingement point 14 to be continually cooled and cleaned, while preventing localized overheating of the target surface. However, if other factors require it, speeds of several hundred rpm may be used equally well. In short, the rotational speed of the drum is not critical. Further, there may be provided a spray nozzle 15 to spray the non-wetting liquid on the rotating drum. Scraper 16 removes bits of slag which may adhere to the drum. Both nozzle spray and scraper 16 are used to prepare or restore the target surface condition. Receptor 17, which collects the granules may be a vessel or a belt conveyor positioned beneath the drum.

The slag stream is accelerated through free fall to velocity u, which is predetermined in accordance with the granule size and size distribution desired. The magnitude of velocity u is controlled by h, the distance between the tip of the cone 19 and the impingement point 14, or by H, or by h and H combined, as well as the temperature of the slag, and d, which determines the flow rate m together with u. The slag droplets are projected several meters through the cooling air, initially causing a solid outer skin to be formed before the droplets fall into receptor 17 as granules.

Conditions in this example were blast furnace slag at a temperature of 1,400° C., H=30 cm, h=1.5 m, d=15 mm, m=50 kg/min, and u=5.9 m/sec (calculated). Drum 12 was a 60 cm outer diameter cylinder, made of a cold rolled sheet steel (0.9 mm thick), rotated between 20 to 200 rpm and internally water cooled. Neither spray nozzle 15 nor scraper 16 was used. The product granules had the properties shown in the Table. No effects were observed by changing the speed of rotation of the drum.

When impinging point 14 is advanced approximately 10° to 20° in the direction of rotation of the target, slag granules 7 are projected at an angle in the direction of rotation. This provides a more efficient collection of granules at receptor 17 because slag cone 18 is symmetrical around A, a line normal to plane B, a line tangent to the drum surface at impingement point 14.

EXAMPLE 3

Figure 3:
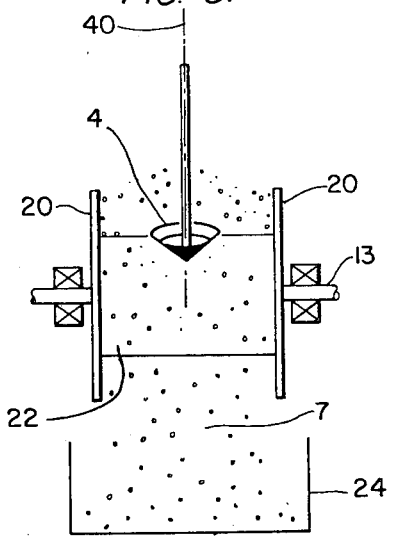
FIG. 3 is a front view of a modified form of the apparatus from FIG. 2.

FIG. 3 shows an improved design of the rotating drum type of target in which flanges 20 at each end of drum 22 serve to deflect the flight of laterally projected droplets in the direction of rotation of the target, thus improving the collection of the granules in receptor 24.

The conditions and apparatus were the same as in Example 2, except d was 30 mm, m was 200 kg/min. Water was sprayed onto the vertical flanges 20 as well as onto drum 22. The results are shown in the Table.

EXAMPLE 4

Figure 4:
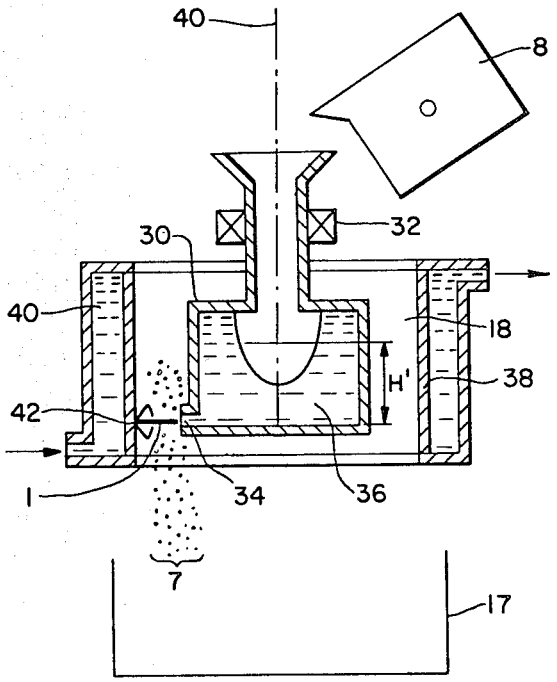
FIG. 4 illustrates another embodiment of the invention.

In FIG. 4, a tundish 30 is rotated about a vertical axis by a mechanism 32, and is provided with a laterally directed nozzle 34. A mass of molten slag 36 of an effective depth H' is maintained in tundish 30. The target is a stationary cylinder 38 which is concentric with the tundish and is externally cooled by a water jacket 40. The inner concave surface of cylinder 38 provides impingement point 42 from slag stream 1. Acceleration of the slag stream 1 to the impingement velocity u is created by centrifugal force upon slag stream 1 by the rotation of tundish 30.

In this example a blast furnace slag was heated to 1,400° C., H'=30 cm (estimated), d=15 mm, effective inner radius of 30=15.5 cm, m=100 kg/min, N=400 rpm, inner radius of cylinder 38=40 cm, u=7.0 m/sec (calculated). The target surface was stainless steel of fine ground finish, and an oil mist was applied to it. The results are shown in the Table.

TABLE

| Properties of Slag Granules | | | | | |
|---|---|---|---|---|---|
| Example No. | Mean Dia. (mm) | Max. dia. (mm) | Occurrence of small granules | Distribution | Strength re. river sands |
| 2 | 3 | 10 | Under 0.5 mm was 1% | Uniform | Same |
| 3 | 2 | 9 | Under 0.5 mm was 2% | Uniform | Same |
| 4 | 4 | 12 | Smallest was 1 mm | Richer in large ones | Slightly softer |

The invention is based on the phenomenon that molten slags can be granulated into spherical particles when striking and rebounding from a nonwetting hard, smooth cooled surface at an impinging velocity of at least about 2 m/sec. The molten slag stream may be accelerated to the desired velocity under an applied gas pressure. The rotating drum target of Examples 2, 3 and 4 may be equipped with a number of partitioning vertical fins (not shown) to adapt the drum target to a multiple-nozzle multiple-slag stream operation. In the embodiment of FIG. 4, a plurality of nozzles 34 may be provided instead of the one shown. Cylindrical target 38 may be made to rotate in the direction counter to tundish 30.

The advantages of this invention are:

(1) it permits manufacture of spherical slag granules with the size and size distribution selectable in a wide range;

(2) it is nonpolluting in that it can be performed in an enclosure to prevent such polluting substances as noxious gases and dusts from escaping into the environmental atmosphere; and (3) because it converts slags, a substance that is often a mere waste, into a useful substance by means of a simple, rugged, and inexpensive apparatus for a small power expenditure, it is economical, energy saving, and resources saving.

We claim:

1. An apparatus for producing granules from molten metallurgical slag, comprising:

a. a container for the molten slag, and having an outlet for a stream of the slag, b. a cooled non-wetting target surface having a high degree of smoothness adjacent to and spaced from the outlet for receiving by impingement, a stream of the molten slag from the outlet of the container, c. means to direct the stream of molten slag from the outlet to impinge upon the target surface at a velocity to cause the stream to rebound therefrom and form an expanding film in the form of an inverted cone with the apex at the point of impingement on the target surface, wherein the cone is formed from degenerating expanding flying rings of the slag from which droplets are subsequently formed and projected along the cone form, d. means to provide cooling air through which the projected droplets pass to cool and solidify to form the granules, and e. means to collect the solid granules.

2. The apparatus of claim 1 wherein the target surface is the peripheral surface of a rotating drum.

3. The apparatus of claim 1, wherein the container is a rotating cylinder having a vertical axis and a lateral aperture from which the molten slag is projected as a stream against the target, wherein the target comprises the inner surface of a cylinder concentrically surrounding the rotating container.

4. The apparatus of claim 1 wherein the target surface comprises plural sides, one side receiving the impinging molten slag, and the opposite side having means for receiving a cooling fluid for cooling the target surface.

* * * * *